US005348072A

United States Patent [19]

Keutgen et al.

[11] Patent Number: 5,348,072

[45] Date of Patent: Sep. 20, 1994

[54] CONTINUOUS CASTING PLANT FOR THE CONTINUOUS HORIZONTAL CASTING OF METALS

[75] Inventors: Franz Keutgen; Heinz-Josef Leuwer, both of Lissendorf; Dieter Perings, Büdesheim; Peter Stadler, Netphen; Rüdiger Winterhager, Freudenberg, all of Fed. Rep. of Germany

[73] Assignee: Mannesmann Aktiengesellschaft, Dusseldorf, Fed. Rep. of Germany

[21] Appl. No.: 23,772

[22] Filed: Feb. 22, 1993

[30] Foreign Application Priority Data

Feb. 21, 1992 [DE] Fed. Rep. of Germany ..... 4205772

[51] Int. Cl.[5] ..... B22D 11/04; B22D 47/00

[52] U.S. Cl. ..... 164/420; 164/440

[58] Field of Search ..... 164/420, 440, 490, 438

[56] References Cited

U.S. PATENT DOCUMENTS

| | | | |
|---|---|---|---|
| 3,446,269 | 5/1969 | Buschmann et al. | 164/420 X |
| 3,782,447 | 1/1974 | Willim et al. | 164/420 |
| 4,195,685 | 4/1980 | Sladkoshteev et al. | 164/420 |
| 4,632,173 | 12/1986 | Kaneko et al. | 164/420 X |
| 4,714,105 | 12/1987 | Keutgen et al. | 164/420 |

FOREIGN PATENT DOCUMENTS

| | | | |
|---|---|---|---|
| 2-16182 | 4/1990 | Japan | 164/440 |
| 4-4948 | 1/1992 | Japan | 164/440 |

*Primary Examiner*—J. Reed Batten, Jr.

*Attorney, Agent, or Firm*—Cohen, Pontani, Lieberman, Pavane

[57] ABSTRACT

A continuous casting plant for the horizontal casting of steel in several strands includes a casting ladle with two discharge openings provided in the bottom of the casting ladle. Each discharge opening is provided with a closure device. Each discharge opening has at least one tundish channel provided with at least one outlet opening. A mold fixedly attachable to the tundish channel is arranged in axial alignment with each outlet opening. Each tundish channel is mounted with the corresponding mold or molds on a tundish car. The tundish cars are movable underneath the casting ladle horizontally and transversely of the casting direction on a track formed by rails between a preparation position and a casting position. Between the preparation position and the casting position, the rails have rail sections which are displaceable from the rail travel direction. The length of the rail sections is such that the rail sections can receive one of the tundish cars.

5 Claims, 3 Drawing Sheets

CONTINUOUS CASTING PLANT FOR THE CONTINUOUS HORIZONTAL CASTING OF METALS

BACKGROUND OF THE INVENTION

1. Field of the Invention

The present invention relates to a continuous casting plant for the horizontal casting of metals, particularly steel, in several strands.

2. Description of the Related Art

Plants for the continuous horizontal casting of steel with a tundish for receiving the melt and at least one mold fastened to the tundish are known, for example, from EP 0 077 316 B1. Plants of this type are usually designed with respect to the number of molds in such a way that the content of a casting ladle can be continuously cast within the time which is predetermined by the melting times of the furnaces and is available as a result. If problems occur during casting on the tundish or on a mold or aim on the melt supply device of the tundish to the mold, the casting must be interrupted, and the remainder of the melt still in the casting ladle must be cast in a static casting or must be charged back into the furnace.

SUMMARY OF THE INVENTION

Therefore, it is the primary object of the present invention to provide a multiplestrand casting plant in which several melts or casting ladles can be continuously cast without interrupting the casting, i.e., in a so-called sequence casting.

In accordance with the present invention, a continuous casting plant for the horizontal casting of metals, particularly steel, in several strands and with horizontal drawing off of the strands, has the following features: a casting ladle with two discharge openings arranged in the bottom of the casting ladle. Each discharge opening is provided with a closure device. At least one tundish channel is provided for each discharge opening. Each tundish channel has at least one outlet opening. A mold which can be fixedly connected to the tundish channel is arranged in axial alignment with each outlet opening. Each tundish channel with the corresponding mold or molds is mounted on a tundish car. The tundish cars can be displaced underneath the casting ladle horizontally and transversely to the casting direction on a track formed by rails between a preparation position and a casting position. Between the preparation position and the casting position, the rails have a section which can be displaced from the travel direction of the rails, wherein the length of the rails of this section is dimensioned in such a way that the section can receive a tundish car.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described a preferred embodiment of the invention.

BRIEF DESCRIPTION OF THE DRAWING

In the drawing.

In the drawings, like components are denoted with like reference numerals.

DESCRIPTION OF THE PREFERRED EMBODIMENT

Figure 1:
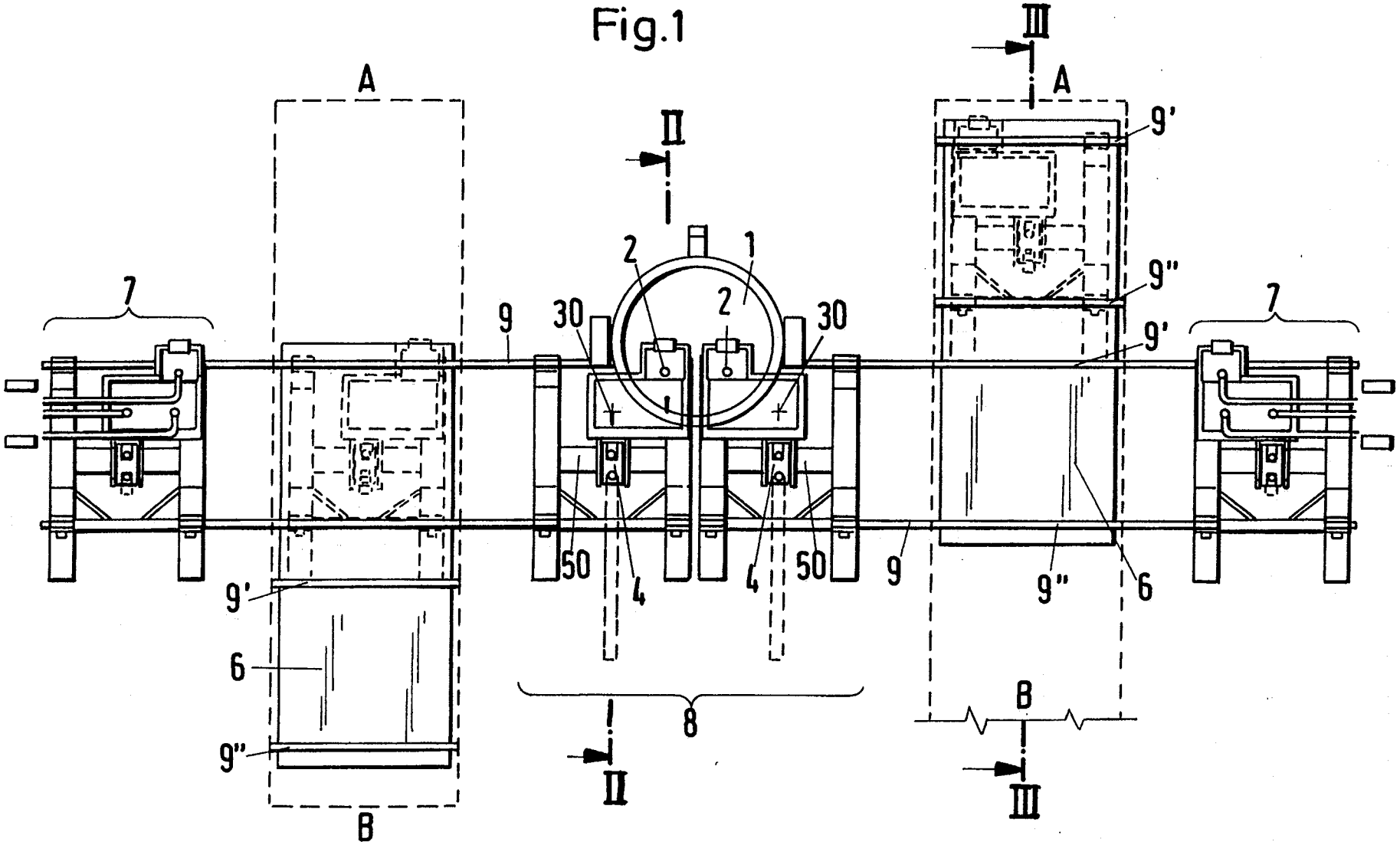
FIG. 1 is a plan view of the continuous casting plant according to the present invention.
Figure 2:
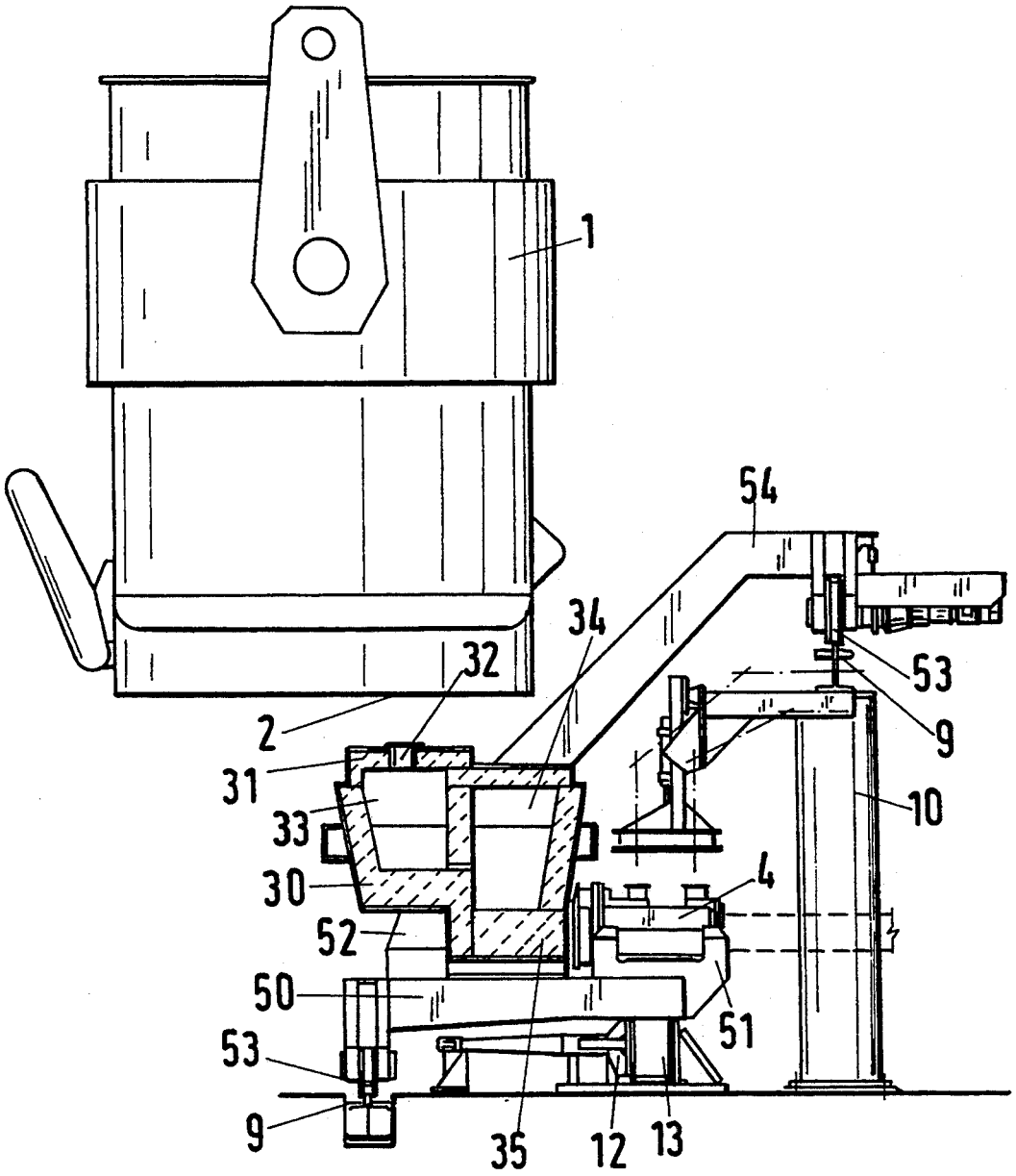
FIG. 2 is a side view, on a larger scale and partly in section, taken along sectional line II—II of FIG. 1.
Figure 3:
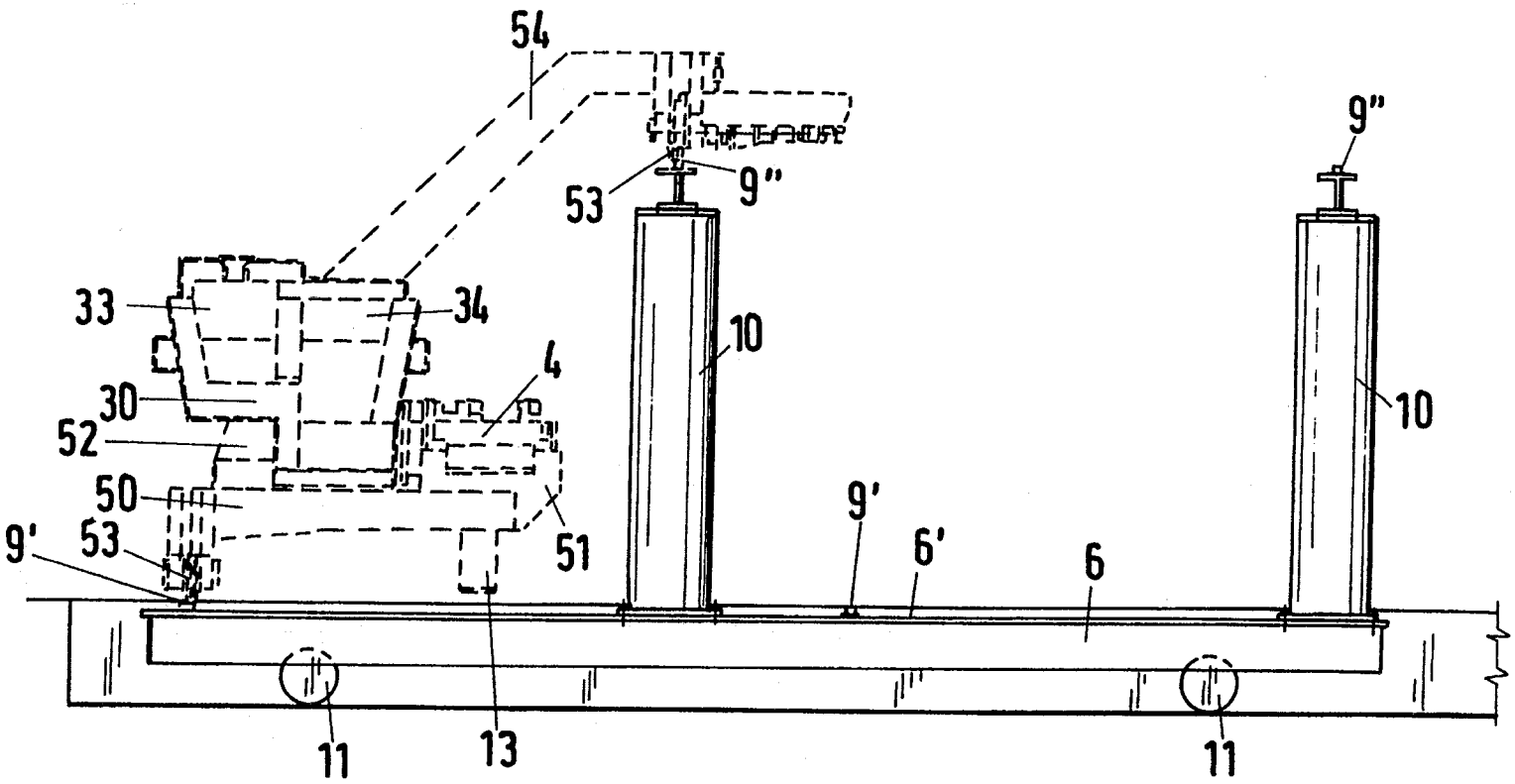
FIG. 3 is another side view, partly in section, taken along sectional line III—III of FIG. 1.

The plant for the continuous horizontal casting illustrated in FIGS. 1–3 includes a casting ladle 1 which contains a melt. The melt is supplied through two discharge openings 2 to an outer chamber 33 of a tundish channel 30. For this purpose, openings 32, which are in axial alignment with the discharge openings 2 of the casting ladle 1, are provided in a cover 31 of the tundish channel 30. The outer chamber 33 is connected to the tundish space 34, to which connected at least one mold 4 and, through an outlet opening 35, the tundish space 34.

The tundish chambers 30 and the molds 4 connected thereto are mounted on tundish cars 50. Each tundish car 50 has one or more supports 51 for one or more molds 4 arranged next to each other, as well as a stand 52 on which the tundish channel 30 is fastened. The tundish car 50 is mounted on wheels 53 and can travel on rails 9 which extend transversely of the casting direction. The tundish car 50 travels on the rails 9 between a casting position 8 underneath the casting ladle 1 and a preparation station 7. The rails 9 extend in two planes which are vertically offset relative to each other in such a way that one rail is located in the plane of the casting platform and the other rail is vertically offset in a plane above the mold.

Accordingly, the wheels 53 supporting the tundish car 50 are fastened on the tundish car 50 underneath the outer chamber 33, on the one hand, and on a cantilever arm 54 of the tundish car 50 which extends up to the level of the upper rails 9, on the other hand.

Two tundish cars 50, completely equipped with tundish channel 30 and molds 4, are provided for each discharge opening 2 of the casting ladle 1. As illustrated in FIG. 1, one of the tundish cars 50 is in the casting position 8, and the other of the tundish cars 50 is in the preparation position 7. In the preparation position 7, the tundish channel 30 is heated in the known manner for the casting operation.

Between the casting position 8 and the preparation position 7, rail sections 9', 9'' are arranged on a displacement carriage 6 which is displaceable transversely of the travel direction of the rails. The length of the sections 9', 9'' is dimensioned in such a way that they can receive a tundish car 50.

The displacement carriage 6 is illustrated in FIG. 3. The displacement carriage 6 includes a base plate 6' located on the level of the casting platform and wheels 11 mounted underneath the base plate 6'. The base plate 6' has track sections which are formed by two rail sections 9', 9'' arranged next to each other. Within the track sections, one of the rail sections 9' is mounted immediately on or in the base plate 6', while the other respective rail section 9'' is mounted on a vertically higher level on a support structure 10.

When a problem occurs during the casting operation, this arrangement makes it possible to move one of the tundish cars 50 from the casting position 8 initially onto the displacement carriage 6, as shown in broken lines in the left-hand portion of FIG. 1, and subsequently to move the tundish car 50 on the displacement carriage 6 out of the track 9, as illustrated by broken lines in the right-hand portion of FIG. 1, to such an extent that the other rail sections 9', 9'' of the displacement carriage 6 which are not occupied by the tundish car 50 again complete the track 9, and the tundish car 50, which is in the preparation position 7, can easily be moved into the casting position 8.

The exact casting position is determined by a clamping element 12 which is arranged on the casting platform and which can receive a bolt 13 arranged underneath the tundish car 50 and locks the tundish car 50 in the casting position.

Accordingly, the present invention provides the advantage that a very compact construction of the entire casting plant is achieved for the normal casting operation. In addition, depending on the number and cross section of the molds, it is possible to feed different amounts of melt from the casting ladle to the two tundishes arranged underneath, and in the case of problems with the molds or with one of the tundishes, the respective casting unit can be easily exchanged without having to interrupt the entire casting operation.

Moreover, the continuous casting plant makes it possible to easily adapt the casting cycle to the melting cycle.

It is also possible to carry out a size change, i.e., the exchange of molds, without interrupting the casting operation.

In addition, it is possible, in the case of sequence casting, to carry out any necessary quality change during the casting sequence, i.e., tundish change toward the end of the casting operation.

It should be understood that the preferred embodiment and examples described are for illustrative purposes only and are not to be construed as limiting the scope of the present invention which is properly delineated only in the appended claims.

We claim:

1. A continuous casting plant for the horizontal casting of steel in a plurality of strands and with horizontal drawing-off of the strands, comprising a casting ladle having a bottom, two discharge openings defined in the bottom, a closure device for each discharge opening, tundish cars movable on rails extending horizontally and transversely to the casting direction between a preparation position and a casting position underneath the casting ladle, each tundish car having at least one tundish channel aligned with the discharge opening when in the casting position and each tundish channel having at least one outlet opening, a mold arranged in axial alignment with each outlet opening, and means for fixedly connecting the mold to the tundish channel, the rails extending in a travel direction, having rail sections between the preparation position and the casting position and means for displacing the rail sections out of the travel direction, wherein the rail sections have a length sufficient for receiving one of the tundish cars.

2. The continuous casting plant according to claim 1, wherein the means for displacing the rail sections is a displacement carriage, the displacement carriage being displaceable in a direction extending transversely of the travel direction, the displacement carriage having second rail sections, the displacement carriage being displaceable such that one of the rail sections and the second rail sections are in alignment with the travel direction.

3. The continuous casting plant according to claim 2, wherein the rail sections are mounted on the displacement carriage on different vertical levels.

4. The continuous casting plant according to claim 3, wherein one rail section is mounted directly on the displacement carriage and another rail section is mounted on a vertically higher level on a support structure.

5. The continuous casting plant according to claim 4, wherein each tundish car has a cantilever arm extending to the vertically higher level, the cantilever arm having a free end, a driven wheel being mounted on the free end of the cantilever arm and being mounted so as to travel on the rail on the vertically higher level, and wheels traveling on the rail section mounted directly on the displacement carriage being arranged underneath the tundish channel on the tundish car.

* * * * *